US010384909B2

(12) United States Patent
Becker et al.

(10) Patent No.: US 10,384,909 B2
(45) Date of Patent: Aug. 20, 2019

(54) HOUSEWRAP INSTALLATION APPARATUS

(71) Applicants: Rusty Becker, Red Wing, MN (US); Thomas Lorch, Rochester, MN (US)

(72) Inventors: Rusty Becker, Red Wing, MN (US); Thomas Lorch, Rochester, MN (US)

( * ) Notice: Subject to any disclaimer, the term of this patent is extended or adjusted under 35 U.S.C. 154(b) by 347 days.

(21) Appl. No.: 15/353,484

(22) Filed: Nov. 16, 2016

(65) Prior Publication Data

US 2017/0137254 A1 May 18, 2017

Related U.S. Application Data

(60) Provisional application No. 62/256,208, filed on Nov. 17, 2015, provisional application No. 62/340,626, filed on May 24, 2016.

(51) Int. Cl.

| | |
|---|---|
| ***B65H 75/42*** | (2006.01) |
| ***B65H 75/44*** | (2006.01) |
| ***B66F 11/04*** | (2006.01) |
| ***E04B 1/62*** | (2006.01) |

(52) U.S. Cl.

CPC ..... *B65H 75/425* (2013.01); *B65H 75/4468* (2013.01); *B66F 11/04* (2013.01); *E04B 1/625* (2013.01)

(58) Field of Classification Search

CPC ..... B65H 16/00; B65H 16/005; B65H 16/06; B65H 35/002; B65H 35/0086; B65H 67/085; B65H 75/425; B65H 75/4468; B65H 2511/12; B66F 11/04; E04B 1/625; G09F 7/18

See application file for complete search history.

(56) References Cited

U.S. PATENT DOCUMENTS

| | | | | |
|---|---|---|---|---|
| 4,811,918 A * | 3/1989 | Grooms | B07B 1/48 | 242/153 |
| 5,667,165 A * | 9/1997 | Gardner | B65B 67/085 | 242/588.2 |
| 5,725,173 A * | 3/1998 | Yasnogorodskiy | B65H 16/00 | 160/24 |
| 5,738,294 A * | 4/1998 | Yasnogorodskiy | B65H 16/00 | 160/24 |
| 5,743,484 A * | 4/1998 | Baskett | B65H 16/00 | 242/557 |
| 7,237,745 B2 * | 7/2007 | Martinez | B65H 16/06 | 242/588.2 |

* cited by examiner

*Primary Examiner* — William A. Rivera
(74) *Attorney, Agent, or Firm* — Schwegman Lundberg & Woessner, P.A.

(57) ABSTRACT

A roll dispensing apparatus is disclosed herein that comprises a height-adjustable materials platform and vertical roller for dispensing and assisting with the installation of bulk roll materials such as house wrap. In an example, the roll dispensing apparatus is a housewrap installation apparatus, providing attachment mechanisms that enable the attachment of the apparatus to a motorized lift, basket, or like moveable working platform. Accordingly, use of the housewrap installation apparatus can enable a single-person installation of housewrap or other rolled materials from a moveable platform, including installation of housewrap materials of a significant height or width.

21 Claims, 12 Drawing Sheets

HOUSEWRAP INSTALLATION APPARATUS

PRIORITY CLAIM

The present application claims priority to: U.S. Provisional Patent Application Ser. No. 62/256,208, filed Nov. 17, 2015, and titled "HOUSEWRAP INSTALLATION APPARATUS"; and to U.S. Provisional Patent Application Ser. No. 62/340,626, filed May 24, 2016, and titled "HOUSEWRAP INSTALLATION APPARATUS"; both of these applications are incorporated by reference herein in their entirety.

BACKGROUND

Housewrap is commonly installed on a number of building types, including single-family and multi-family homes, commercial buildings, and the like. Housewrap is used to provide a weather-resistant barrier that is installed over sheathing but underneath the siding. Many housewrap products, including synthetic housewrap such as Dupont TYVEK®, are relatively thin and are provided to contractors on large rolls for installation. Such rolls may be between eight and ten feet long, with a roll length that may be between 100 and 200 feet. Existing techniques for installing housewrap on buildings typically involves the use of multiple persons, such as deploying a first person to unroll the housewrap and hold the roll in place, and a second person to fasten the housewrap to the building.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Configurations and methods of use for a roll dispensing apparatus are generally disclosed herein. In one example, a roll dispensing apparatus is provided for attachment to a work platform, for the attachment, deployment, use, and installation of a roll of material (e.g., a housewrap roll). The roll of material can be furled (e.g., wrapped) around a circular roll tube. This configuration of the roll dispensing apparatus, further referred to herein as a housewrap dispensing apparatus or an apparatus to dispense material, is adapted for the installation of a roll of material by a single operator. Thus, although the housewrap roll may extend to a width of 8 to 10 feet (and a span of 8 to 10 feet when vertically or horizontally positioned against a building), the use of the presently disclosed housewrap dispensing apparatus can allow a single operator to fully control the dispensing of the housewrap roll and proceed with installation activities.

Figure 1:
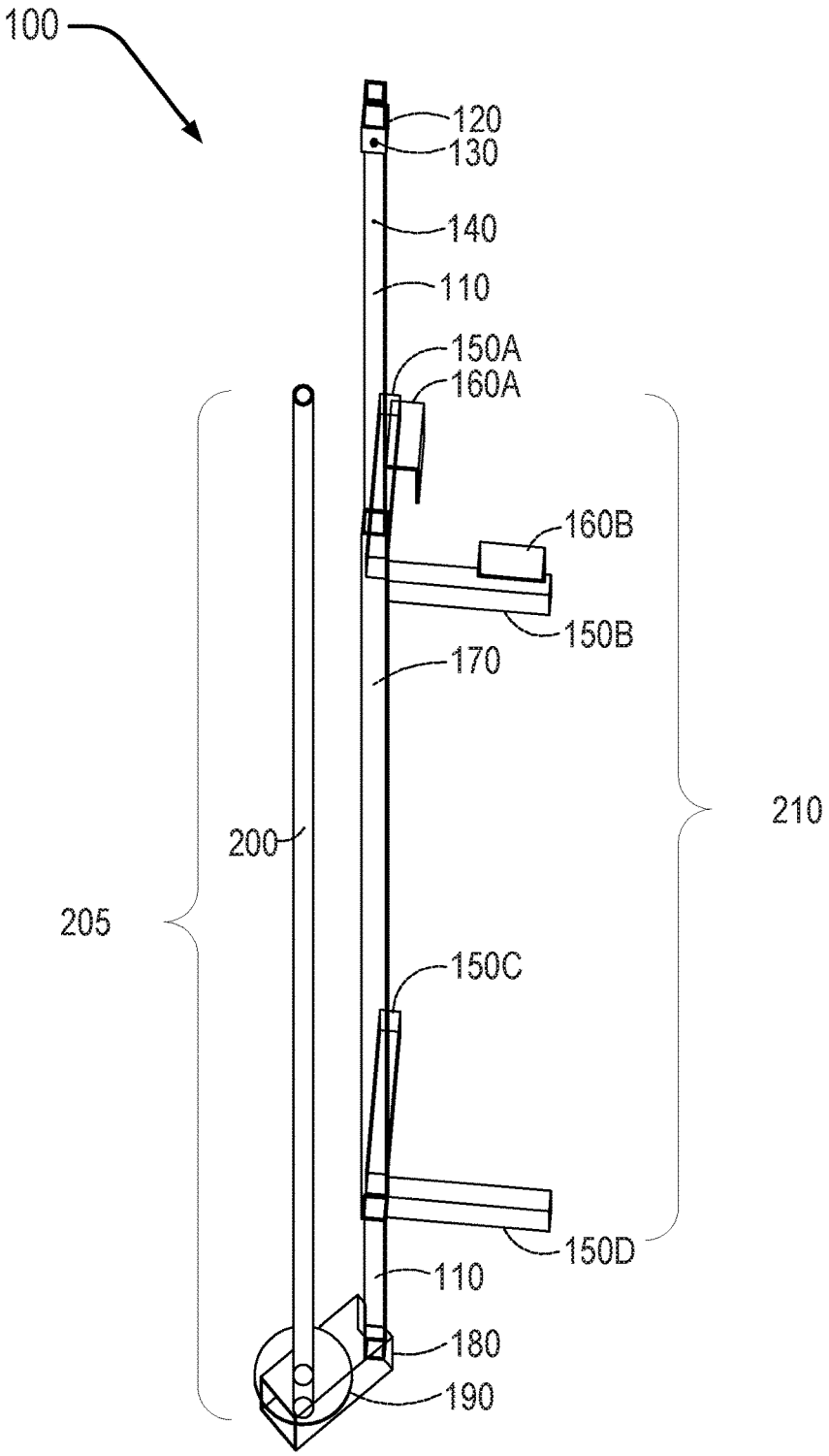
FIG. 1 provides a side view illustration of a housewrap installation apparatus adapted for attachment to an aerial work platform, according to an example.

FIG. 1 provides a side view illustration of a housewrap installation apparatus 100 adapted for attachment to an aerial work platform, according to an example. The housewrap installation apparatus 100 can also be referred to as an apparatus to dispense material. The housewrap installation apparatus 100 can include a first tube member 110 (e.g., a shaft member), extending vertically (relative to the ground), in an orientation that can be parallel to a pipe member 200 (e.g., a material shaft) also extending vertically from a plate member 180 (e.g., a joining member). The pipe member 200 can be included as a component of a material holder 205. The pipe member 200 can be of a sufficient diameter to be inserted within a housewrap roll (e.g., a roll of material or a furled roll of material), while extending in length to approximately to half the width of the housewrap roll. The pipe member 200 can extend to a length sufficient to securely retain the roll of material in an upright position, relative to the ground surface. The first tube member 110 can be coupled to the plate member 180, which in turn can be coupled to the pipe member 200, the plate member 180 being positioned generally perpendicular to the first tube member 110 and the pipe member 200. The plate member 180 can link the material holder 205 with the first tube member 110.

In an example, the first tube member 110 is a square steel tube that is 78" in length, the square steel tube having dimensions of 1¼"×1¼"×⅛" thick. In an example, the pipe member 200 is a round steel pipe that is 60" in length, the steel pipe having dimensions of 1¼"×⅛ " thick. Thus, the pipe member 200 may be configured to extend five feet, allowing the insertion and placement of a housewrap roll that is nine feet in length, allowing the holding of the housewrap roll in an orientation that is parallel to the first tube member 110. In an example, the plate member 180 is a 2"×3⁵⁄₁₆" thick steel tube, that is 7¾" long. In other examples, the pipe member 200 may be of a smaller size to accommodate other dimensions of rolls (such as 3 foot or 4 foot rolls).

The pipe member 200 can be coupled to a round plate 190 (e.g., a base plate) of a generally circular configuration that is configured to hold or position (e.g., retain) a housewrap roll of a sufficient thickness. The round plate 190 can be included as a component of the material holder 205. In an example, the round plate 190 is a 6"×⅛" diameter steel plate. In an example, the round plate 190 may be fixed to the plate member 180. In another example, the round plate 190 may rotate relative to the plate member 180, to allow the rotation of the pipe member 200 and the roll relative to the plate member 180. Such rotation of the round plate 190 when a roll is inserted upon the pipe member 200 may be enabled through a rotating plate or rotating shaft (provided, in some examples, with the use of bearings), and like rotational mechanisms. The apparatus to dispense material can include a bearing coupled between the plate member 180 and the material holder 205 to allow the rotation of the material holder 205 relative to the plate member 180.

The material holder 205 can include a tensioner, brake, or other halting mechanism (not shown) that is configured to allow the roll of material to rotate relative to the housewrap installation apparatus 100 when a specified force is applied to the roll of material. In an example, a tensioner can be coupled between the round plate 190 and the plate member 180 to allow the round plate 190 to rotate relative to the plate member 180 when a specified force is applied to a roll of material that is positioned on the round plate 190. For example, with use of a tensioner, a specified force can include a sufficient amount of force that is applied by an operator to unfurl the roll of material, whereas a specified force does not include a force that is insufficient to allow the roll of material to unfurl when applied by an operator. In other examples, the tensioner, brake, or stopping mechanism may be manually engaged and released by a user.

The first tube member 110 (e.g., a shaft member) can be configured to receive, or be received by, an attachment mechanism 210, through the insertion and positioning of the first tube member 110 inside a second tube member 170 (e.g., a sleeve). As shown in FIG. 1, the first tube member 110 extends from a first end coupled to the plate member 180 to a second opposite end, while the second tube member 170 is arranged to be positioned, slid, and fixed at a desired height relative to the first tube member 110. The attachment mechanism 210 can be designed, or configured, for attachment to a basket of a work platform (e.g., a portion of a work platform), through the use of a series of corner arms 150A, 150B, 150C, 150D (e.g., one or more support arms), and a set of mounting brackets 160A, 160B (e.g., one or more support brackets). The support brackets 160A-B can be coupled to the support arms 150A-D. These corner arms 150A-D can be coupled to the second tube member 170 at 90 degree angles relative to each other, to enable positioning on a corner of the work platform, as further described below. The support brackets 160A-B can be configured to couple with a portion of the work platform, such as by hooking over a portion (e.g., a railing) of the work platform, clasping a portion of the work platform, grasping a portion of the work platform, having fasteners pass through the support brackets 160A-B and a portion of the work platform, or the like.

The first tube member 110 may be set to a desired position relative to a basket of a work platform, through positioning of the second tube member 170 relative to the first tube member 110 and the pipe member 200. Stated another way, the first tube member 110 can linearly translate at least one direction within the second tube member 170. The linear translation of the first tube member 110 can result in a corresponding linear translation of the material holder 205. The linear translation of the first tube member 110, for example, can result in a corresponding linear translation of the pipe member 200. The desired height may be established at a variety of heights through the use of a height adjustment stop 120 (e.g., a shaft retainer) on the first tube member 110 attached through a fastener 130. The height adjustment stop 120 can prevent the linear translation of the first tube member 110 in at least one direction within the second tube member 170. In one example, the height adjustment stop 120 may include a third tube member that is configured to prevent further insertion of the first tube member 110 into the second tube member 170, for example a 1½×1½×⅛" thick steel tube, of 1½ length, that is coupled to the first tube member 110 through a nut and bolt used for the fastener 130. The first tube member 110 may include a plurality of mounting positions, such as is depicted with unused fastener position 140 (for example, a round hole extending through the first tube member to receive a bolt of the fastener 130 and the positioning of the third tube member).

The corner arms 150A, 150B can be positioned to extend at 90 degree angles from a first end of the second tube member 170, and the corner arms 150C, 150D are likewise positioned to extend at 90 degree angles from the second opposite end of the second tube member 170. In one example, the corner arms 150 are respectively 1¼"×1¼"×⅛" thick steel tubes, that are 10" long. Accordingly, the two sets of corner arms are configured for mounting and positioning to the exterior of a corner of a work platform, such as a work platform of an aerial work platform (further depicted in FIGS. 3A-4B). The corner arms 150A, 150B can be respectively coupled to mounting brackets 160A, 160B, for placement and attachment of the mounting brackets 160A, 160B over a side railing of the work platform (also further depicted in FIGS. 3B-4B). Stated another way, the one or more support arms 150A-D in combination with the one or more support brackets 160A-B can allow for the attachment mechanism to grasp a portion of the work platform. In one example, the mounting brackets 160A-B are 2"×2"×⅛" thick steel angle pieces, that are 4" long.

Figure 2:
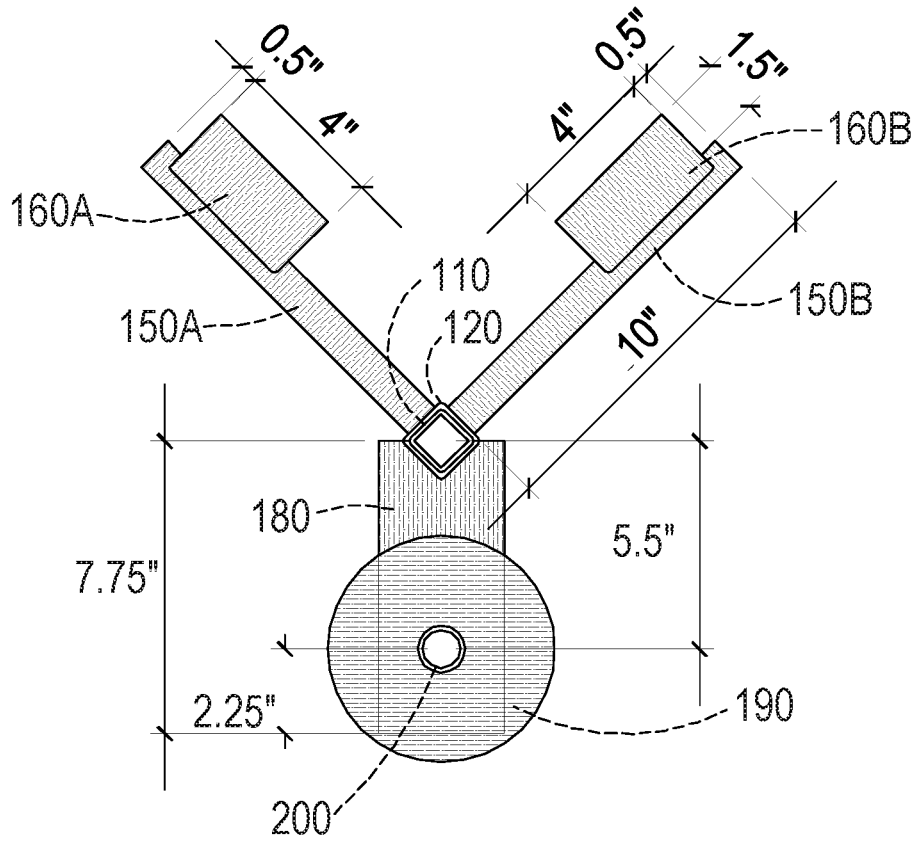
FIG. 2 provides a plan view illustration of the housewrap installation apparatus of FIG. 1 adapted for attachment to an aerial work platform, according to an example.

FIG. 2 provides a plan view illustration of the housewrap installation apparatus 100 of FIG. 1 adapted for attachment to an aerial work platform, according to an example. FIG. 2 includes dimensions and orientations for the plate member 180, round plate 190, the corner arms 150A-B, and the mounting brackets 160A-B. It will be understood that the dimensions, shape, and design of the corner arms 150A-B and the mounting brackets 160A-B may be changed to fit other types of work platforms, likewise, the dimensions, shape, and design of the plate member 180 and the round plate 190 may be changed to fit other types of rolls and products to be dispensed.

Figure 3A:
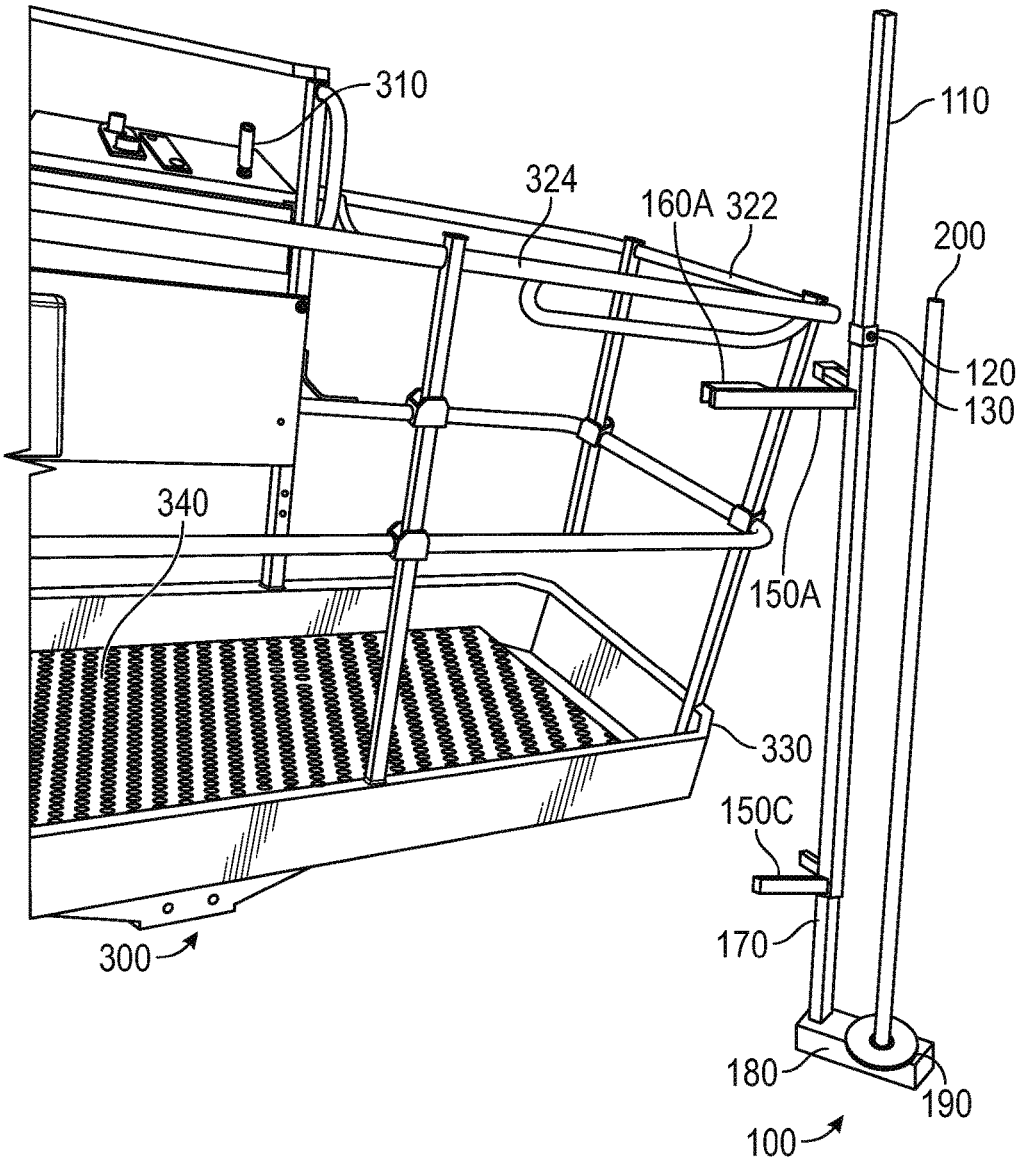
FIG. 3A illustrates a housewrap installation apparatus detached from an aerial work platform, according to an example.

FIG. 3A illustrates a housewrap installation apparatus 100 detached from an aerial work platform 300, according to an example. The housewrap installation apparatus 100 can be attached to a work platform, or detached from a work platform. As shown, the housewrap installation apparatus 100 is configured for attachment to an aerial work platform 300 of an aerial work platform machine, at the corner 330 of a railing of the aerial work platform 300.

Figure 3B:
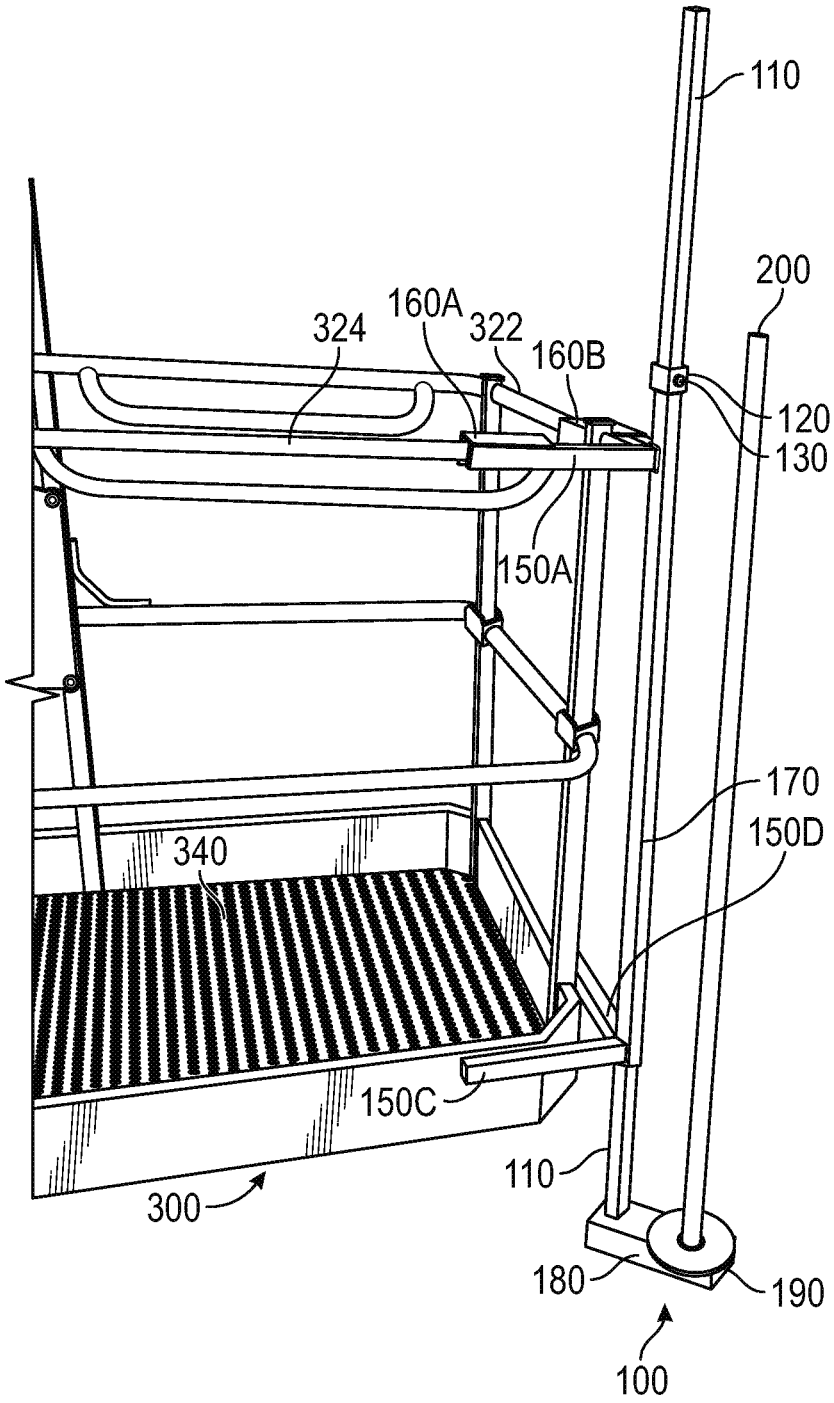
FIG. 3B illustrates the housewrap installation apparatus of FIG. 3A attached to an aerial work platform, according to an example.

FIG. 3B illustrates the housewrap installation apparatus 100 of FIG. 3A attached to an aerial work platform 300, according to an example. For example, corner arms 150A and 150B are shaped to attach to the metal railings 322, 324 of the aerial work platform 300 through mounting brackets 160A, 160B. The corner arms 150C, 150D are similarly shaped to be attached at corners of the platform floor 340 and provide stability for the attachment mechanism.

Figure 3C:
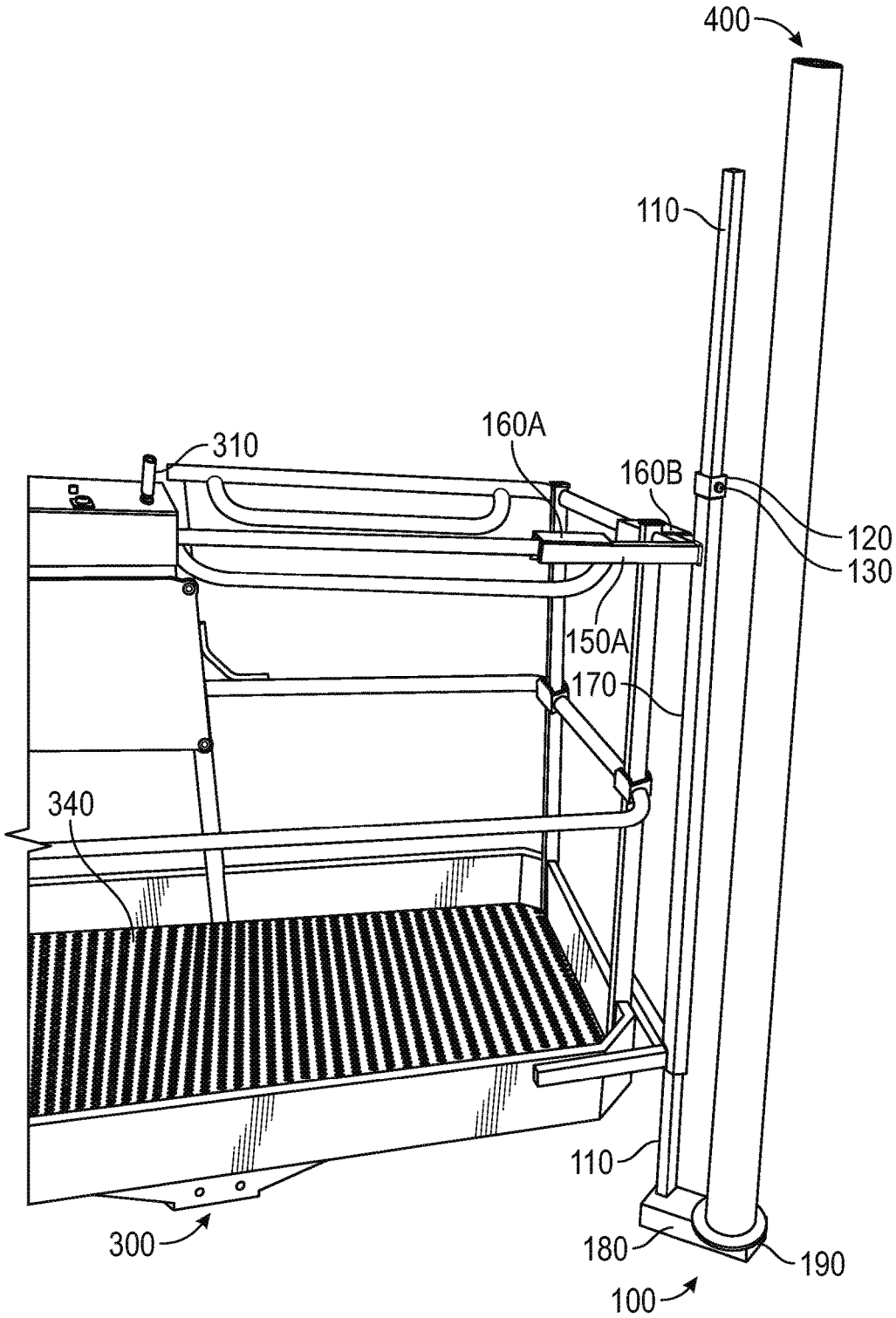
FIG. 3C illustrates a housewrap installation apparatus of FIGS. 3A and 3B attached to an aerial work platform and loaded with a housewrap roll, according to an example.

FIG. 3C illustrates a housewrap installation apparatus 100 of FIGS. 3A and 3B attached to an aerial work platform 300 and loaded with a housewrap roll 400, according to an example. As shown, due to the positioning of the attachment mechanism 210 and the material holder 205, the housewrap roll 400 extends below the platform floor 340, and above the metal railings 324, 322 of the aerial work platform 300. Accordingly, this allows a single human operator of standard height to be able to reach areas from the platform 300, and perform installation activities of the housewrap roll 400 below the platform 300, at the level of the platform 300, as well as a sufficient arms-length span above the platform 300. Further, the housewrap installation apparatus 100 holds the housewrap roll in place to allow operation of the aerial work platform control 310 and to allow the operator to walk around area of the platform floor 340.

Figure 4A:
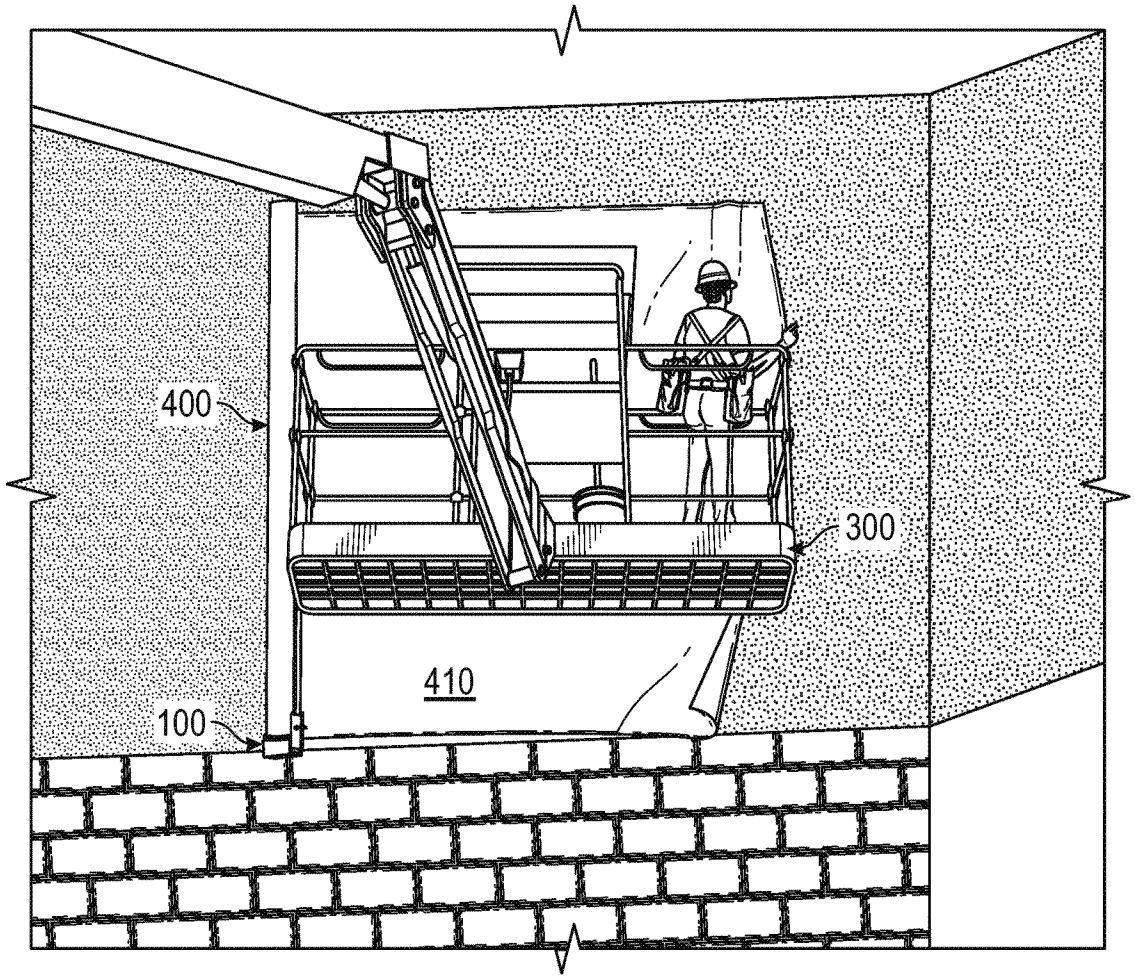
FIG. 4A illustrates use of a housewrap installation apparatus during installation activity from an aerial work platform, according to an example.

FIG. 4A illustrates use of a housewrap installation apparatus 100 during installation activity of the housewrap roll 400 from the aerial work platform 300, according to an example. It will be appreciated that the embodiments described herein are not limited to the installation of housewrap, but that the embodiments described herein can be used in conjunction with any roll of material (including with roll dispensing activities that occur outside of construction activities).

The roll of material dispensed during the installation activity can have a length dimension that ranges from two feet to ten feet. As shown in FIG. 4A, the operator is able to pull the housewrap from the housewrap roll 400, as the operator has extended a length of the housewrap for installation 410. The height adjustable nature of the housewrap installation apparatus 100 allows for the housewrap roll 400 to be positioned sufficiently below the platform 300 to allow installation of the housewrap from the housewrap roll 400 based on the characteristics of the operator, the housewrap, and the building installation. Accordingly, the ability to adjust the housewrap installation apparatus 100 to allow the housewrap roll 400 to extend both below and above the platform 300 provides a significant advantage over existing installation techniques.

Figure 4B:
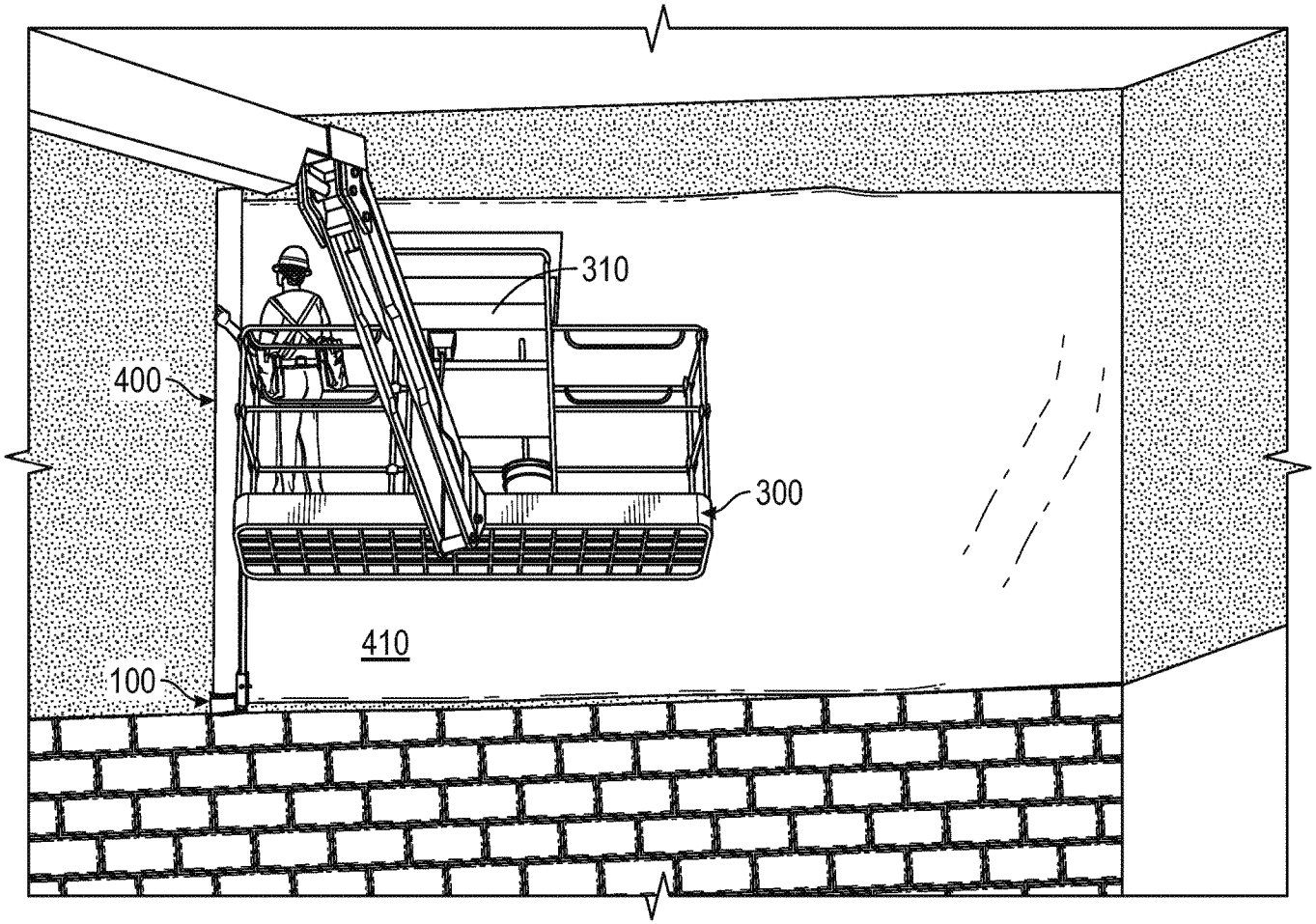
FIG. 4B illustrates a further use of a housewrap installation apparatus during installation activity from an aerial work platform, according to an example.

FIG. 4B illustrates a further use of a housewrap installation apparatus 100 during installation activity of the housewrap roll 400 from the aerial work platform 300, according to an example. As shown, the operator has moved the aerial work platform 300, and is able to manually manipulate the roll to further unwind/unroll the housewrap for installation 410. In some examples, where the housewrap roll 400 is able to rotate on the housewrap installation apparatus 100, the movement of the aerial work platform 300 parallel to the side of the building may automatically allow the housewrap roll 400 to unroll and allow simple installation. The movement of the aerial work platform 300 can be a specified force applied to the roll of material that is sufficient to allow the roll of material to unfurl when the housewrap installation apparatus 100 includes a tensioner.

The housewrap installation apparatus 100 can allow a single operator to be able to proceed with installation activities, due to the housewrap installation apparatus 100 holding the housewrap roll 400 in a relatively fixed position. Thus, there is no need for a second operator to hold or reposition the roll of material.

Figure 5A:
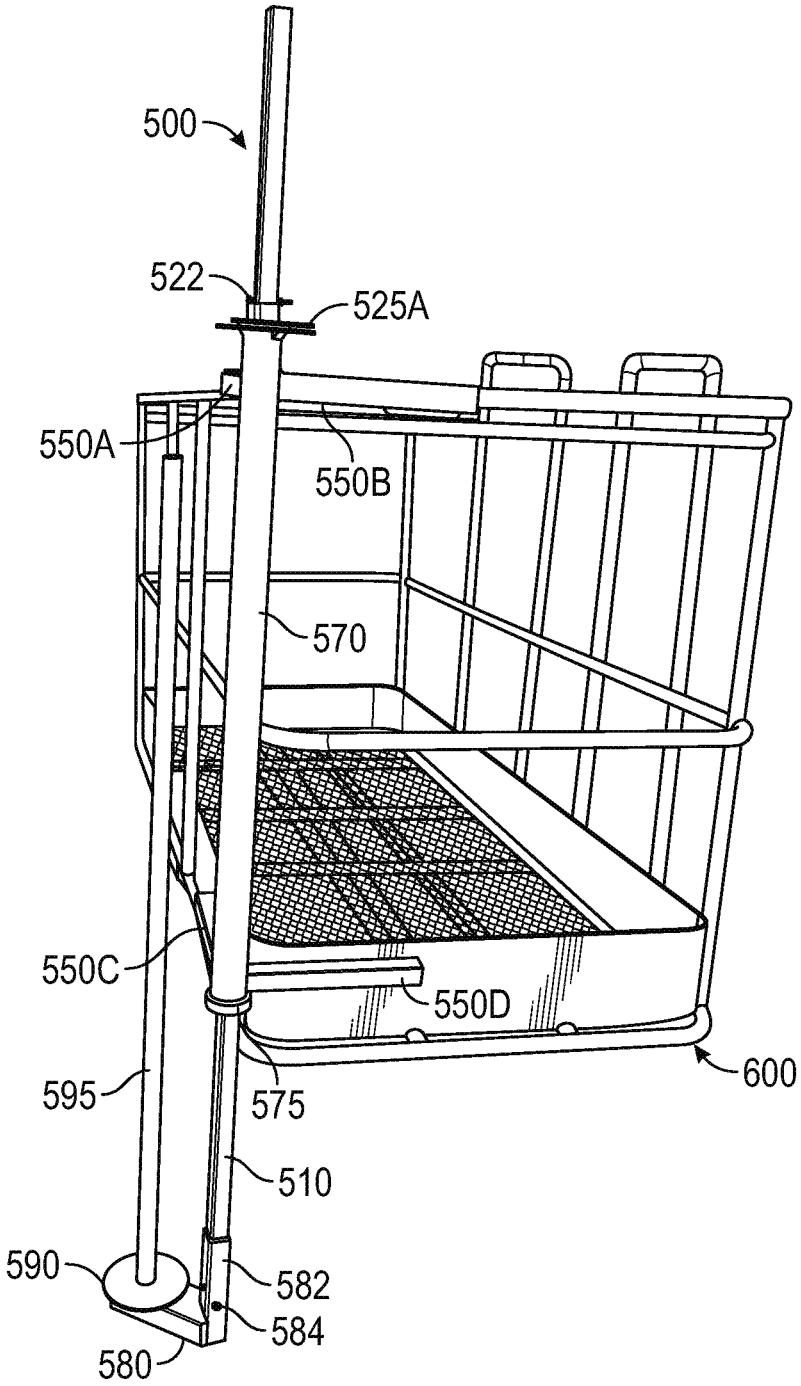
FIG. 5A illustrates another example of a housewrap installation apparatus adapted to rotate among multiple positions on an aerial work platform, according to an example.

FIG. 5A illustrates another example of a housewrap installation apparatus 500 adapted to rotate among multiple positions on an aerial work platform 600, according to an example. The housewrap installation apparatus 500 depicted in FIGS. 5A to 5E illustrates an adaptation of the design of the housewrap installation apparatus 100 previously illustrated in FIGS. 1 to 4B. It will be understood that many of the features, materials, and uses discussed for the housewrap installation apparatus 100 are also applicable to the housewrap installation apparatus 500.

Similar to the housewrap installation apparatus 100, the housewrap installation apparatus 500 depicted in FIG. 5A includes a first tube member 510 (e.g., a shaft member), extending vertically, in an orientation that is parallel to a pipe member 595 (e.g., a material shaft). The pipe member 595 can also extend vertically from a plate 590 (e.g., a base plate or other plate or platform). The plate 590 can be a round or circular plate. Further, the pipe member 595 can extend from a plate member 580 (e.g., a joining member). The pipe member 595 can be adapted to be partially inserted into a housewrap roll (not shown) or another a roll of material (not shown).

The housewrap installation apparatus 500 can include an attachment mechanism. The attachment mechanism can include arm members 550A, 550B, 550C, 550D (e.g., one or more support arms) that can be used for placement and attachment with a side railing, floor, or frame of the aerial work platform 600. The attachment mechanism can be configured to attach to the work platform 600 without the use of arm members 550A-D, such as through the use of fasteners, clamps, welding, or the like. The first tube member 510 can extend from the plate member 580 through an inner diameter of a second tube member 570 (e.g., a sleeve), allowing for height-adjustable positioning. The height of the first tube member 510 can be adjusted (e.g., positioned) through use of a shaft retainer (e.g., a clamp, a sleeve, a positioning bolt 522, or the like). The housewrap installation apparatus 500 may include a powder coating, although other types of durable paints and coatings (such as zinc coating) may also be applied to the exterior surface of the respective members.

With the housewrap installation apparatus 500, the position of the plate member 580 and the pipe member 595 may be rotated to one of a plurality of positions, through the use of a rotation member 575 (e.g., bushing, bearing, or other rotational mechanism) that hosts the first tube member 510 within the second tube member 570. The second tube member 570 is depicted as being of a generally round shape, allowing free rotation of the first tube member 510 to any number of positions within the second tube member 570. The second tube member 570 can be other shapes (e.g., square or other polygons), but then configured to allow the first tube member 510 to freely rotate within the second tube member 570, such as through the use of an adaptor, bearings, or the like. As further described with reference to FIG. 5E below, the position of the first tube member 510 within the second tube member 570 may be set at one of multiple rotation positions through a use of rotation plate member 525A, and a locking fastener pin 527.

Additionally, the plate member 580 or a portion of a material holder can be configured to be selectively decoupled from the first tube member 510. The material holder can include the pipe member 595 and the plate 590. In an example, the plate member 580 of the housewrap installation apparatus 500 is shown as including a removable attachment to the first tube member 510, through the use of a third tube member 582, attached to and extending from the plate member 580. For example, in the configuration of FIG. 5A, the third tube member 582 extends approximately 8 inches from the plate member 580. The third tube member 582 is shown as being coupleably attached to the first tube member 510 through fastener pins 584 and 586 located on opposite sides of the third tube member 582. Whereas the configuration of housewrap installation apparatus 100 shows a permanent (e.g., welded) attachment between the plate member 180 directly to the first tube member 110, the configuration of housewrap installation apparatus 500 including the third tube member 582 allows detachment of the plate member 580 (and the accompanying pipe member 595 and plate 590) from the first tube member 510. As previously stated, the plate member 580 can also be detached from the pipe member 595 and the plate 590. As a result, the third tube member and the attached plate member 580, plate 590, and pipe member 595 may be easily removed from the housewrap installation apparatus 500 if one of these parts becomes bent or broken (or, for allowing interchanging with another shape or type of the plate member 580, plate 590, or pipe member 595). The housewrap installation apparatus 500 can be configured to be disassembled into its constituent pieces, such as through the use of mating threads, sleeves, fasteners, or the like. In an example, the first tube member 510, second tube member 570, third tube member 582, plate member 580, plate 590, and the pipe member 595 can all be configured to be assembled and/or disassembled by a user, such as for storage or replacement of components.

In a further example, the plate 590 is attached to the plate member 580 via a rotation mechanism (e.g., a bushing or a bearing), allowing the plate 590 and the pipe member 595 to rotate relative to the plate member 580. This attachment may be accompanied by the use of a tensioner or other rotational control mechanisms, to control the rate of rotation (or to permit/stop rotation) of the plate 590 or the pipe member 595. For example, the use of a tensioner may prevent the housewrap roll that is placed onto the plate 590 and the pipe member 595 from unrolling (e.g., unfurling) out of a user's control.

Figure 5B:
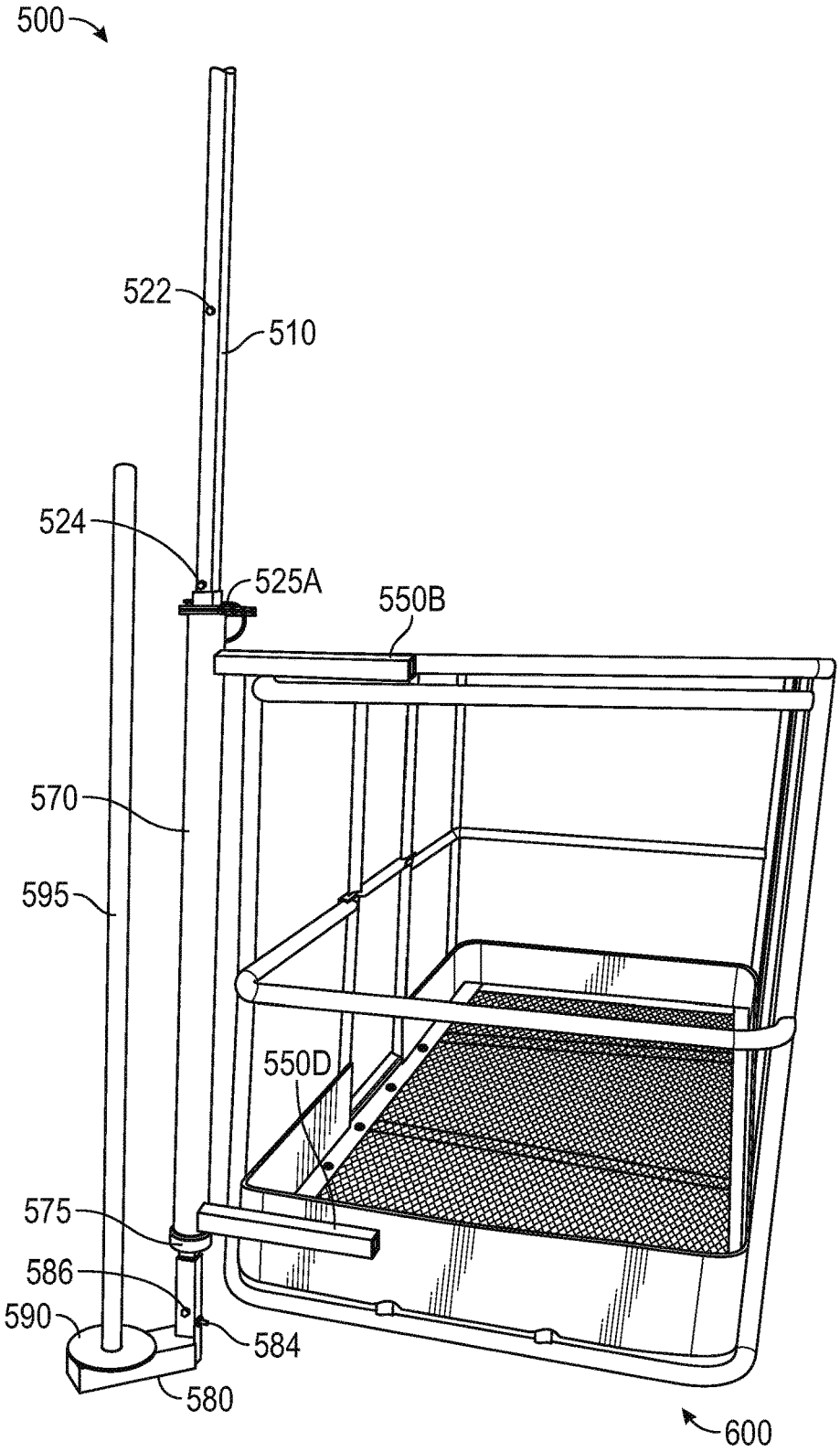
FIG. 5B illustrates a further example of the housewrap installation apparatus of FIG. 5A, rotated into a second position on the aerial work platform, according to an example.

FIG. 5B illustrates a further example of the housewrap installation apparatus 500 of FIG. 5A, rotated into a second position on the aerial work platform 600, according to an example. As shown, the position of the plate member 580, the plate 590, and the pipe member 595 have been rotated over 90 degrees counter-clockwise relative to the aerial work platform 600 (e.g., about a longitudinal axis of the first tube member 510). Such rotation of the plate member 580, the plate 590, and the pipe member 595 may be used to allow the repositioning of the housewrap roll around corners of a building, for example, to follow the exterior contour of the building when installing a continuous sheet of housewrap. The housewrap installation apparatus can be rotated into a second position through manipulation of a positioning mechanism 529 (shown in FIG. 5E).

Additionally, in FIG. 5B, the first tube member 510 has also been extended relative to the aerial work platform 600, to position the first tube member 510 with the location positioning bolt 524, thus moving the bottom of the plate member 580 (and the position of the plate 590 and the pipe member 595) upwards towards the aerial work platform 600. Further height adjustment of the first tube member 510 may be implemented consistent with the discussion above for the first tube member 110. Height adjustment of the first tube member 510 can also be achieved through the use of one or more sleeve holes and one or more shaft holes. The shaft holes and sleeve holes can be configured to be aligned. The shaft holes and the sleeve holes can be configured to allow a shaft retaining pin to translate through both the shaft holes and the sleeve holes. The insertion of a shaft retaining pin into the aligned shaft and sleeve holes can prevent the linear translation of the first tube member 510 within the second tube member 570.

Figure 5C:
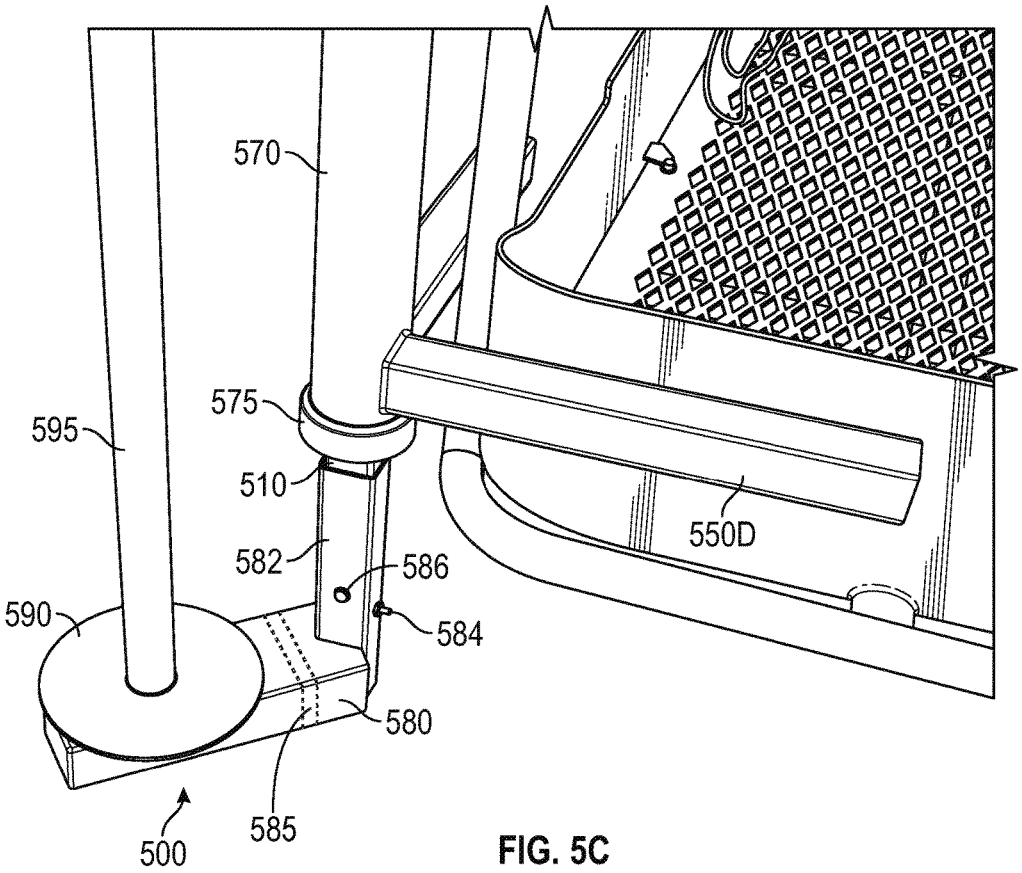
FIG. 5C illustrates a closeup perspective view of the plate member of the housewrap installation apparatus of FIGS. 5A and 5B, according to an example.

FIG. 5C illustrates a closeup perspective view of the plate member 580 of the housewrap installation apparatus 500 of FIGS. 5A and 5B, according to an example. The perspective view of FIG. 5C specifically illustrates the location of the first tube member 510 located within the rotation member 575, and the attachment of the third tube member 582 as a collar piece attached to the first tube member 510 with fastener pins 584 and 586. Although bolts are shown as being used for the fastener pins 584 and 586, other types of removable pins, fasteners, or fastening mechanisms may be used.

Figure 5D:
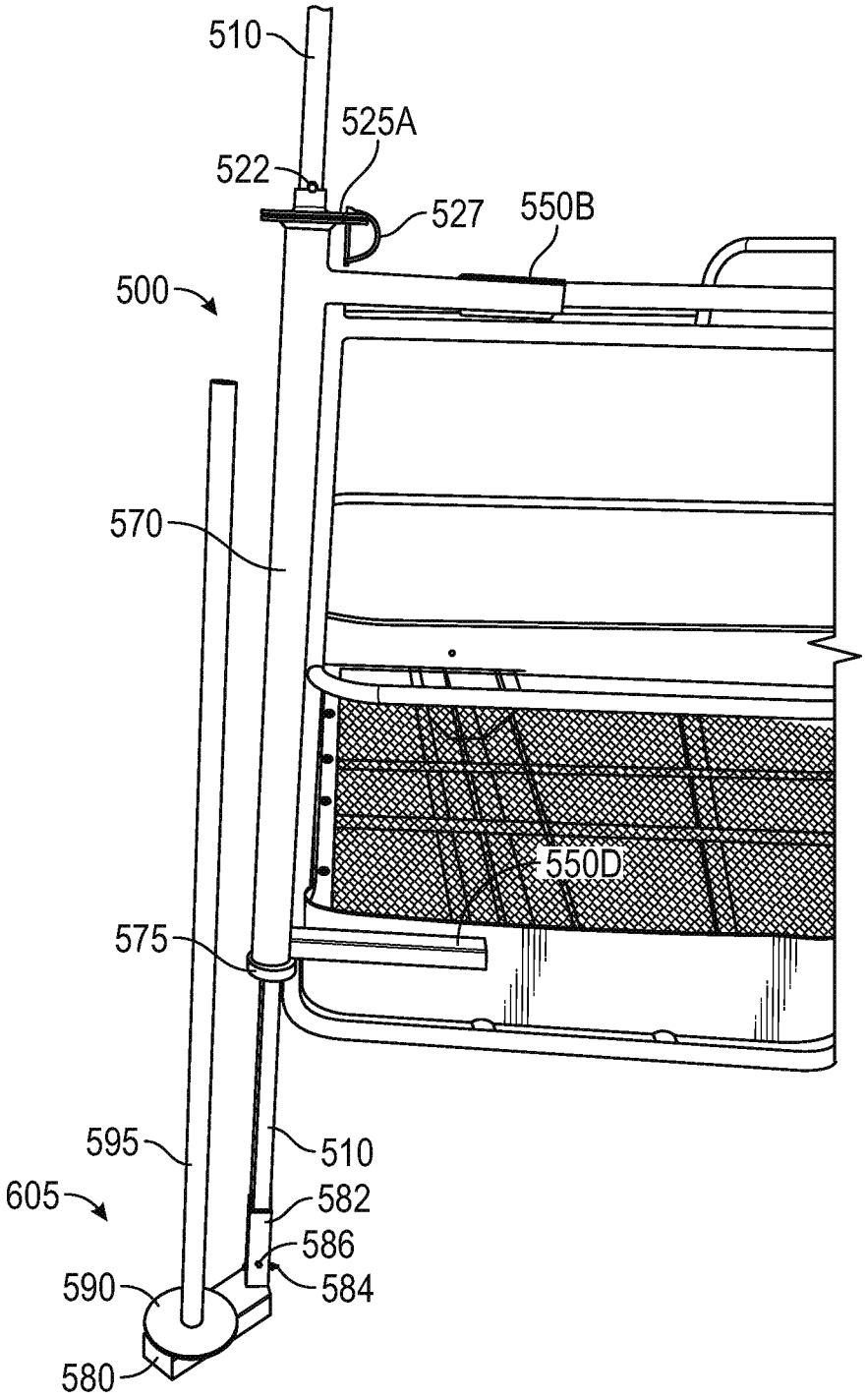
FIG. 5D illustrates a further example of the housewrap installation apparatus of FIG. 5A, rotated and extended into a third position on the aerial work platform, according to an example.

FIG. 5D illustrates a further example of the housewrap installation apparatus 500 of FIG. 5A, rotated and extended into third position on the aerial work platform 600, according to an example. FIG. 5D specifically shows an orientation of the rotation plate member 525A including the use of a locking fastener pin 527 that is inserted within the rotation plate member 525A. Although a round wire lock pin is shown as being used for the locking fastener pin 527, other types of fasteners such as bolts, clevis pins, or the like may be used within the rotation plate members 525A, 525B.

Figure 5E:
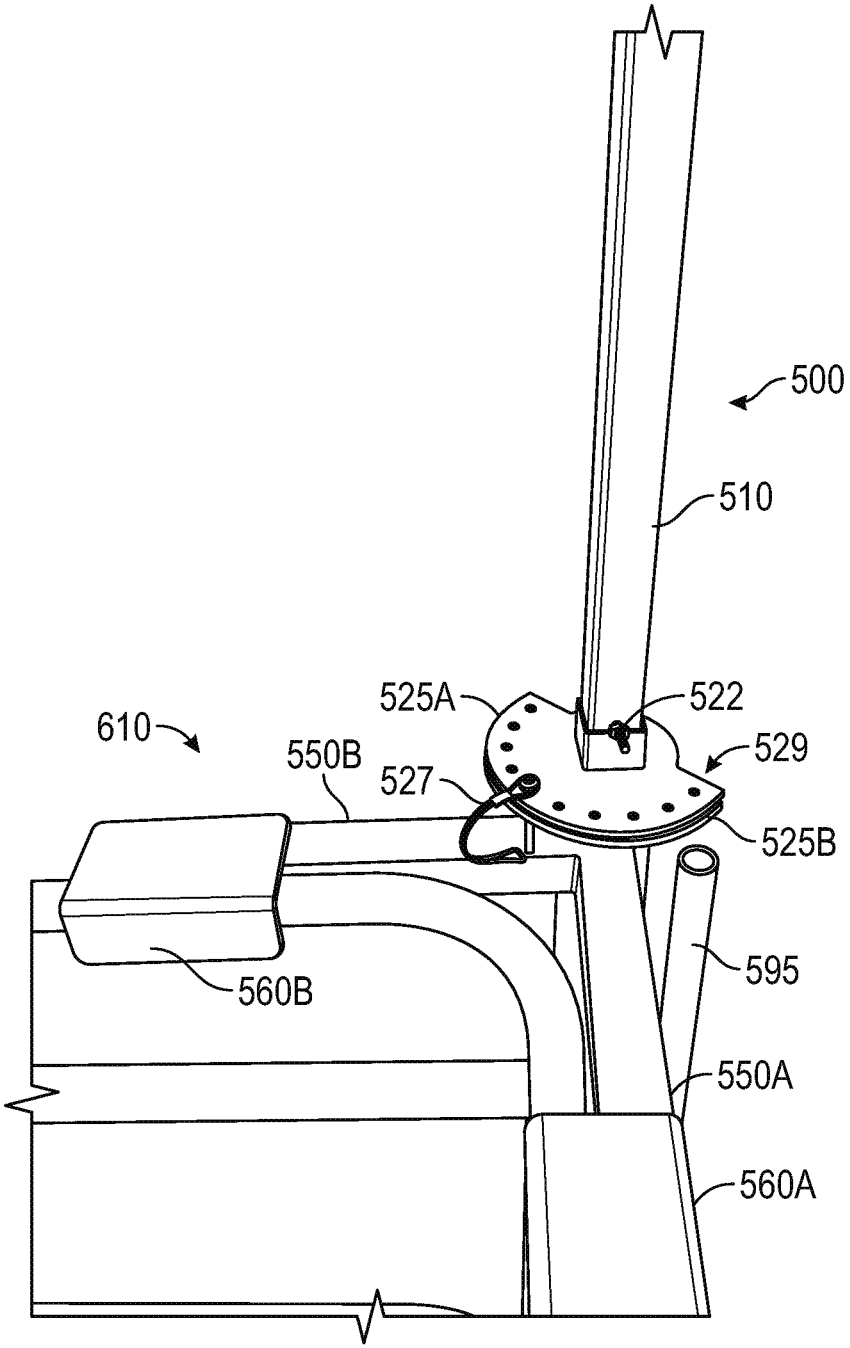
FIG. 5E illustrates a closeup top perspective view of a positioning mechanism of the housewrap installation apparatus of FIG. 5A, according to an example.

FIG. 5E illustrates a closeup top perspective view of the positioning mechanism 529 of the housewrap installation apparatus 500 of FIG. 5D, according to an example. The positioning mechanism 529 can include rotation plate members 525A, 525B. As shown, the rotation plate members 525A, 525B each include a plurality of positions along a semi-circle (e.g., 180 degree) plane, with the rotation plate members 525A, 525B rotating relative to one another. Additionally, FIG. 5E further shows the attachment of the arm members 550A, 550B to the aerial work platform via mounting brackets 560A, 560B respectively. The mounting brackets 560A, 560B respectively may include one or more holes to allow insertion of pins or adjustable fastening mechanisms, to allow secure but removable attachment and coupling of the housewrap installation apparatus 500 to the basket bars (e.g., railings) of the aerial work platform 600.

The rotation plate member 525A may be fixably coupled to the first tube member 510. For instance, the rotation plate member 525A can include a square shaped inner aperture for engaging with the first tube member 510 and is thus adapted to rotate with the first tube member 510, whereas the rotation plate member 525B can be permanently coupled to the second tube member 570 (and the arm members 550A, 550B). As a result, this configuration allows rotation of the first tube member 510 within the second tube member (not shown) up to 180 degrees, to placement at one of the ten positions available for the locking fastener pin 527. Fewer or additional positions for the locking fastener pin 527 may be provided within the rotation plate members 525A, 525B.

In a further example, the vertical positioning features described and depicted with reference to FIGS. 5A to 5E may also be applied to allow repositioning of the housewrap roll along other axes, including an axis that is parallel (e.g., horizontal to the ground surface) to the aerial work platform, or another rotated axis located between 0 to 90 degrees. Thus, the housewrap installation apparatus 500 may be oriented in a horizontal or near-horizontal position (e.g., with the use of one or more pivoting points) to allow sheeting to be installed along a vertical or near-vertical path (relative to the ground surface), such as through the use of an orientation mechanism 585. The orientation mechanism 585 can be included in the attachment mechanism 210 and allow the sleeve to rotate relative to the work platform 600

(or relative to the one or more support arms 550A-D) such that the material holder is adaptively positionable within a range from a fully vertical orientation to a fully horizontal orientation, or positions in between, relative to the ground surface.

Although the present structures were described with reference to specific materials such as steel pipes, tubes, and bolts, and certain dimensions, it will be understood that a variety of other material types suitable for mounting to a work platform may also be used. It will be understood that the applicability of the identified structures, configurations, and techniques extends to other types of materials beyond housewrap, including any number of materials that are dispensed from rolls. A variety of modifications may be made to the presently described brackets and attachment mechanisms to fit and attach to other types of platforms, lifts, and mechanical work structures, including articulated and telescoping boom lifts, scissor lifts, boom lifts, buckets, lift tables, lift machines, and the like. It will be further understood that these attachment mechanisms may even include semi-permanent mountings that allow the close integration of the material holding apparatus with the platform and work structure.

The above detailed description includes references to the accompanying drawings, which form a part of the detailed description. The drawings show, by way of illustration, specific examples in which the invention can be practiced. These examples are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

Additional examples of the presently described apparatus, system, and method embodiments include the following, non-limiting configurations (including methods of manufacture, installation, use, and operation of the following configurations). Each of the following non-limiting examples may stand on its own, or may be combined in any permutation or combination with any one or more of the other examples provided below or throughout the present disclosure.

Example 1 is an apparatus to dispense material from a roll of material, comprising: a material holder, wherein: the material holder is configured to receive the roll of material and allow the roll of material to rotate about the material holder, and the material holder includes a base plate for retaining the roll of material; an attachment mechanism including a sleeve, wherein: the sleeve is configured to receive a shaft member, wherein the shaft member is configured to linearly translate within the sleeve, and the attachment mechanism is configured to be coupled to a work platform; a joining member that is coupled to the material holder and the shaft member and links the material holder with the shaft member, wherein linear translation of the shaft member results in a corresponding linear translation of the material holder; and a shaft retainer, the shaft retainer sized and shaped to prevent the linear translation of the shaft member in at least one direction within the sleeve.

In Example 2, the subject matter of Example 1 optionally includes wherein the attachment mechanism includes: one or more support arms; and one or more support brackets, coupled to the one or more support arms, the one or more support brackets configured to grasp a portion of the work platform.

In Example 3, the subject matter of Example 2 optionally includes wherein the portion of the work platform is a railing of the work platform.

In Example 4, the subject matter of any one or more of Examples 2-3 optionally include wherein the portion of the work platform is a frame of the work platform.

In Example 5, the subject matter of any one or more of Examples 1-4 optionally include wherein the joining member is configured to be selectively decoupled from the shaft member or the material holder.

In Example 6, the subject matter of any one or more of Examples 1-5 optionally include wherein the material holder includes a material shaft that is configured to be inserted into the roll of material.

In Example 7, the subject matter of any one or more of Examples 1-6 optionally include wherein the work platform is a component of a boom lift.

In Example 8, the subject matter of any one or more of Examples 1-7 optionally include a rotational mechanism coupled to the sleeve, wherein the rotational mechanism is configured to allow the shaft member to rotate within the sleeve. In some examples, the rotational mechanism can include a locking mechanism to inhibit (e.g., prevent or substantially prevent) the rotation of the shaft member within the sleeve.

In Example 9, the subject matter of any one or more of Examples 1-8 optionally include wherein the shaft retainer is coupled to the shaft member and configured to prevent the shaft member from translating outside of the sleeve.

In Example 10, the subject matter of any one or more of Examples 1-9 optionally include wherein the shaft retainer includes one or more sleeve holes, and wherein the shaft member includes one or more shaft holes, wherein the shaft holes and sleeve holes are configured to be aligned and are configured to allow a shaft retaining pin to translate through both the shaft holes and the sleeve holes, to prevent the linear translation of the shaft member within the sleeve.

In Example 11, the subject matter of any one or more of Examples 1-10 optionally include an orientation mechanism that is configured to allow the received roll of material to rotate relative to the work platform.

In Example 12, the subject matter of Example 11 optionally includes wherein the received roll of material is orientated with the material holder to be substantially perpendicular to a ground surface.

In Example 13, the subject matter of any one or more of Examples 11-12 optionally include wherein the received roll of material is orientated with the material holder to be substantially parallel to a ground surface.

In Example 14, the subject matter of any one or more of Examples 11-13 optionally include wherein the orientation mechanism is coupled between the sleeve and the attachment mechanism and the orientation mechanism allows the sleeve to rotate relative to the work platform.

In Example 15, the subject matter of any one or more of Examples 1-14 optionally include wherein the material holder includes a tensioner configured to allow the roll of material to rotate about the material holder when a specified force is applied to the roll of material.

In Example 16, the subject matter of any one or more of Examples 1-15 optionally include wherein the roll of material is a furled roll of housewrap.

In Example 17, the subject matter of Example 16 optionally includes wherein the furled roll of housewrap is wrapped on a circular roll tube having a length dimension that ranges from two feet to ten feet.

Example 18 is a system for installing material from a roll of material, comprising: a lift machine including a work platform; and a dispensing apparatus to dispense material from the roll of material, the dispensing apparatus comprising: a material holder, wherein: the material holder is configured to receive the roll of material and allow the roll of material to rotate about the material holder, and the material holder includes a base plate for retaining the roll of material; an attachment mechanism including a sleeve, wherein: the sleeve is configured to receive a shaft member, wherein the shaft member is configured to linearly translate within the sleeve, and the attachment mechanism is coupled to a portion of the lift machine; a joining member that is coupled to the material holder and the shaft member and links the material holder with the shaft member, wherein linear translation of the shaft member results in a corresponding linear translation of the material holder; and a shaft retainer, sized and shaped to prevent the linear translation of the shaft member in at least one direction within the sleeve.

In Example 19, the subject matter of Example 18 optionally includes wherein the material is housewrap.

In Example 20, the subject matter of any one or more of Examples 18-19 optionally include wherein the attachment mechanism includes: one or more support arms; and one or more support brackets, coupled to the one or more support arms, the one or more support brackets configured to grasp the portion of the work platform.

In Example 21, the subject matter of any one or more of Examples 18-20 optionally include a rotational mechanism coupled to the sleeve, wherein the rotational mechanism is configured to allow the shaft member to rotate within the sleeve. In some examples, the rotational mechanism can include a locking mechanism to inhibit (e.g., prevent or substantially prevent) the rotation of the shaft member within the sleeve.

The above description is intended to be illustrative, and not restrictive. For example, the above-described examples (or one or more aspects thereof) can be used in combination with each other. Other examples can be used, such as by one of ordinary skill in the art upon reviewing the above description.

The Abstract is provided to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed example. Thus, the following claims are hereby incorporated into the Detailed Description as examples or embodiments, with each claim standing on its own as a separate example, and it is contemplated that such examples can be combined with each other in various combinations or permutations. The scope of the invention should be determined with reference to the appended claims, along with the full scope of equivalents to which such claims are entitled.

What is claimed is:

1. An apparatus to dispense material from a roll of material, comprising:

a material holder, wherein:

the material holder is configured to receive the roll of material and allow the roll of material to rotate about the material holder, and the material holder includes a base plate for retaining the roll of material;

an attachment mechanism including a sleeve, wherein:

the sleeve is configured to receive a shaft member, wherein the shaft member is configured to linearly translate within the sleeve, and the attachment mechanism is configured to be coupled to a work platform;

a joining member that is coupled to the material holder and the shaft member and links the material holder with the shaft member, wherein linear translation of the shaft member results in a corresponding linear translation of the material holder, and wherein the shaft is configured to rotate with respect to the sleeve, and rotation of the shaft within the sleeve correspondingly rotates the joining member and the material holder with respect to the sleeve; and a shaft retainer, the shaft retainer sized and shaped to prevent the linear translation of the shaft member in at least one direction within the sleeve.

2. The apparatus of claim 1, wherein the shaft is repositionable at a plurality of rotational positions with respect to the sleeve, and the apparatus is configured to maintain the position of the shaft relative to the sleeve at one or more of the rotational positions.

3. The apparatus of claim 2, further comprising:

a first positioning member coupled with the shaft and defining a first through hole;

a second positioning member coupled with the sleeve and defining a plurality of alignment holes; and wherein the first through hole and the plurality of alignment holes are configured to receive a fastener, and reception of the fastener in the first through hole and at least one of the alignment holes maintains the position of the shaft relative to the sleeve.

4. The apparatus of claim 2, further comprising:

a first positioning member coupled with the shaft and defining a plurality of alignment holes;

a second positioning member coupled with the sleeve and defining a first through hole; and wherein the first through hole and the plurality of alignment holes are configured to receive a fastener, and reception of the fastener in the first through hole and at least one of the alignment holes maintains the position of the shaft relative to the sleeve.

5. The apparatus of claim 1, wherein the joining member is configured to be selectively decoupled from the shaft member or the material holder.

6. The apparatus of claim 1, wherein the material holder includes a material shaft that is configured to be inserted into the roll of material.

7. The apparatus of claim 1, wherein the attachment mechanism includes:

one or more support arms; and one or more support brackets, coupled to the one or more support arms, the one or more support brackets configured to couple with a portion of the work platform.

8. The apparatus of claim 1, further comprising a rotational mechanism coupled to the sleeve, wherein the rotational mechanism is configured to allow the shaft member to rotate within the sleeve.

9. The apparatus of claim 1, wherein the shaft retainer is coupled to the shaft member and configured to prevent the shaft member from translating outside of the sleeve.

10. The apparatus of claim 1, wherein the shaft retainer includes one or more sleeve holes, and wherein the shaft member includes one or more shaft holes, wherein the shaft holes and sleeve holes are configured to be aligned and are configured to allow a shaft retaining pin to translate through both the shaft holes and the sleeve holes, to prevent the linear translation of the shaft member within the sleeve.

11. The apparatus of claim 1, further comprising an orientation mechanism that is configured to allow the received roll of material to rotate relative to the work platform.

12. The apparatus of claim 11, wherein the received roll of material is oriented with the material holder to be substantially perpendicular to a ground surface.

13. The apparatus of claim 11, wherein the received roll of material is oriented with the material holder to be substantially parallel to a ground surface.

14. The apparatus of claim 11, wherein the orientation mechanism allows the material holder to rotate relative to the work platform.

15. The apparatus of claim 1, wherein the material holder includes a tensioner configured to allow the roll of material to rotate about the material holder when a specified force is applied to the roll of material.

16. The apparatus of claim 1, wherein the roll of material is a furled roll of housewrap.

17. The apparatus of claim 16, wherein the furled roll of housewrap is wrapped on a circular roll tube having a length dimension that ranges from two feet to ten feet.

18. A system for installing material from a roll of material, comprising:

a lift machine including a work platform; and a dispensing apparatus to dispense material from the roll of material, the dispensing apparatus comprising:

a material holder, wherein:

the material holder is configured to receive the roll of material and allow the roll of material to rotate about the material holder, and the material holder includes a base plate for retaining the roll of material;

an attachment mechanism including a sleeve, wherein:

the sleeve is configured to receive a shaft member, wherein the shaft member is configured to linearly translate within the sleeve, and the attachment mechanism is coupled to a portion of the lift machine;

a joining member that is coupled to the material holder and the shaft member and links the material holder with the shaft member, wherein linear translation of the shaft member results in a corresponding linear translation of the material holder, and wherein the shaft is configured to rotate with respect to the sleeve, and rotation of the shaft within the sleeve correspondingly rotates the joining member and the material holder with respect to the sleeve; and a shaft retainer, sized and shaped to prevent the linear translation of the shaft member in at least one direction within the sleeve.

19. The system of claim 18, wherein the material is housewrap.

20. The system of claim 18, wherein the attachment mechanism includes:

one or more support arms; and one or more support brackets, coupled to the one or more support arms, the one or more support brackets configured to grasp the portion of the work platform.

21. The system of claim 18, further comprising a rotational mechanism coupled to the sleeve, wherein the rotational mechanism is configured to allow the shaft member to rotate within the sleeve.

* * * * *